US005851128A

United States Patent [19]

Nakata et al.

[11] Patent Number: 5,851,128

[45] Date of Patent: Dec. 22, 1998

[54] ELECTRICAL CONNECTOR

[75] Inventors: Hiroyuki Nakata; Kazuhiko Hattori, both of Yokkaichi, Japan

[73] Assignee: Sumitomo Wiring Systems, Ltd., Japan

[21] Appl. No.: 588,719

[22] Filed: Jan. 19, 1996

[30] Foreign Application Priority Data

Jan. 19, 1995 [JP] Japan ..... 7-026138

[51] Int. Cl.[6] ..... H01R 13/514

[52] U.S. Cl. ..... 439/752; 439/752.5

[58] Field of Search ..... 439/752, 959, 439/733

[56] References Cited

U.S. PATENT DOCUMENTS

| | | | |
|---|---|---|---|
| 3,792,416 | 2/1974 | Moulin | 439/274 |
| 4,013,331 | 3/1977 | Kobler | 439/595 |
| 4,017,141 | 4/1977 | Bury et al. | 439/56 |
| 4,193,655 | 3/1980 | Herrmann | 439/903 |
| 4,804,341 | 2/1989 | Kato et al. | 439/752 |
| 4,867,712 | 9/1989 | Kato et al. | 439/752 |
| 4,898,548 | 2/1990 | Case et al. | 439/686 |
| 4,969,841 | 11/1990 | Sueyoshi et al. | 439/595 |
| 5,035,638 | 7/1991 | Kourimsky | 439/750 |
| 5,326,287 | 7/1994 | Hamakita et al. | 439/595 |
| 5,342,221 | 8/1994 | Peterson | 439/877 |
| 5,403,213 | 4/1995 | Inabu | 439/752 |
| 5,478,262 | 12/1995 | Yamanashi et al. | 439/752 |

*Primary Examiner*—Neil Abrams
*Assistant Examiner*—T C Patel
*Attorney, Agent, or Firm*—Banner & Witcoff, Ltd.

[57] ABSTRACT

An electrical connector comprises a housing, a terminal mounted within a cavity in the housing, and play-eliminating means for substantially preventing movement of the terminal within the cavity in a direction other than that along which the terminal is inserted into the cavity. The terminal is constituted by a connector member for electrical connection to a complementary terminal, and a wire-connection member for connection to an electrical wire. The wire-connection member has a smaller transverse cross-section than the connector member. The play-eliminating means is constituted by support means positioned in space between the outer periphery of the wire-connection member and the inner periphery of the cavity.

4 Claims, 6 Drawing Sheets

ELECTRICAL CONNECTOR

BACKGROUND OF THE INVENTION

This invention relates to an electrical connector, and in particular to means for eliminating play between a terminal and an associated housing of such a connector.

When an electric wire is to be inserted into the cavity of a connector housing, a terminal is fixed to one extremity of the electric wire. This terminal comprises a connector member which connects with a corresponding terminal, and a crimping member that crimps the core portion of the electric wire. Normally, the crimping member is smaller than the connector member. Accordingly, the interior of the cavity is arranged to correspond to the exterior dimensions of the connector member. However, a predetermined clearance is maintained between the connector member and the cavity in order to facilitate insertion.

In a conventional connector, particularly in the case of high-current connectors, the provision of the clearance between the connector member of the terminal and the interior wall of the cavity results in a heating problem. For example, in the use of portable connectors used in vehicles, after the male and female connectors have been connected, if the vibration of the vehicle is transmitted to the connectors, the connectors tend to move horizontally or vertically. This causes friction between the interengaging portions of the male and female connectors, resulting in an increase in contact resistance, and thereby in the production of heat.

The aim of the invention is to provide a play eliminating structure which controls play in the terminals of an electrical connector, and which can thereby resolve the problem of heating.

SUMMARY OF THE INVENTION

The present invention provides an electrical connector comprising a housing, a terminal mounted within a cavity in the housing, and play-eliminating means for substantially preventing movement of the terminal within the cavity in a direction other than that along which the terminal is inserted into the cavity, the terminal being constituted by a connector member for electrical connection to a complementary terminal, and a wire-connection member for connection to an electrical wire, the wire-connection member having a smaller transverse cross-section than the connector member, wherein the play-eliminating means is constituted by support means positioned in space between the outer periphery of the wire-connection member and the inner periphery of the cavity.

As the position of the terminal is fixed by the support means, play does not occur if the associated electric wire is pulled, or if the housing is vibrated. Consequently, the production of heat caused by friction between the terminal and a complementary terminal is effectively prevented.

Advantageously, the support means includes a resilient support member for resiliently supporting the wire-connection member within the cavity. Thus, even if there is a variation in the cavity size, this can be accommodated by the resilient support member.

In a preferred embodiment, the connector further comprises a retainer for holding the terminal in a predetermined position, the retainer being associated with an aperture formed in the housing, wherein the support means forms part of the retainer, and is positioned to fit in space between the wire-connection member and the inner surface of the cavity when the retainer is inserted into the aperture in the housing. Preferably the support means is constituted by a pair of supports which are positioned, in use, on opposite sides of the wire-connection member so that each support is sandwiched between the wire-connection member and a respective adjacent internal wall of the cavity. Alternatively, the support means is constituted by single support which, in use, abuts an upper surface of the wire-connection member to force the opposite surface of the wire-connection member against an adjacent internal wall of the cavity.

In another preferred embodiment, the support means is constituted by a pair of extension members provided on the wire-connection member, the extension members projecting, in opposite directions, outwardly beyond the periphery of the wire-connection member to contact opposite internal side walls of the cavity.

The invention also provides play-eliminating means for a terminal of an electrical connector, the terminal being constituted by a connector member for electrical connection to a complementary terminal, and a wire-connection member for connection to an electrical wire, the wire-connection member having a smaller transverse cross-section than the connector member, the terminal being formed so as to fit within a cavity provided in a connector housing, wherein the play-eliminating means is constituted by support means positioned in space between the outer periphery of the wire-connection member and the inner periphery of the cavity, thereby substantially preventing movement of the terminal within the cavity in a direction other than that along which the terminal is inserted into the cavity.

BRIEF DESCRIPTION OF THE DRAWINGS

The invention will now be described in greater detail by way of example with reference to the accompanying drawings, in which.

DESCRIPTION OF PREFERRED EMBODIMENTS

Figure 1:
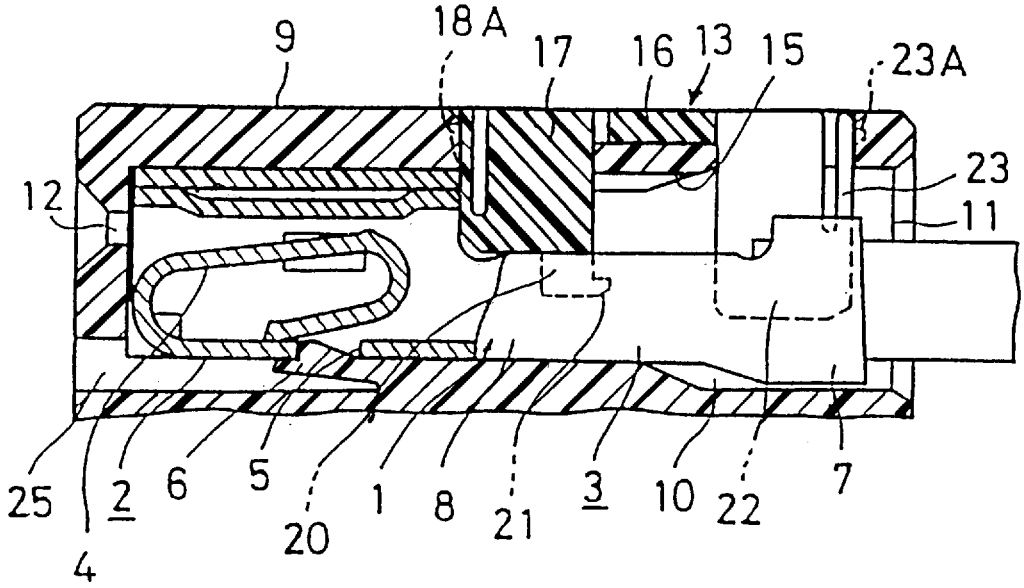
FIG. 1 is a longitudinal cross-sectional view of a first form of electrical connector constructed in accordance with the invention, the connector having a housing, a terminal mounted in the housing and a retainer, the figure showing the retainer in the fully-fitted position.

Referring to the drawings, FIGS. 1 to 9 show a first embodiment of the present invention, in which a female terminal 1 is mounted within a cavity 10 of a housing 9 of an electrical connector. The female terminal 1 is a one-piece member formed from a conducting metal plate. The female terminal 1 has a connector member 2 formed at its front end in order to connect the female terminal to a male terminal (not shown). The female terminal 1 also has a crimping member 3 provided at its rear end for connection to an associated electric wire (not shown).

The connector member 2 is formed into a rectangular tubular shape, and the upper face (as shown in the FIG. 1) is bent back over itself to form a double-plate structure at the top. A resilient contact member 4 is provided at the front end of the base of the connector member 2, the contact member being bent over into an arc shape towards the interior of the connector member 2. The end of the contact member 4 bends inwardly so as to make resilient contact with the base of the connector member 2. A male terminal (not shown) is insertable between the contact member 4 and the upper (double) face of the connector member 2. An aperture 5 is provided in a central portion of the base of the connector member 2, this aperture permitting the attachment, and removal, of a lance 6, as is described below.

Figure 2:
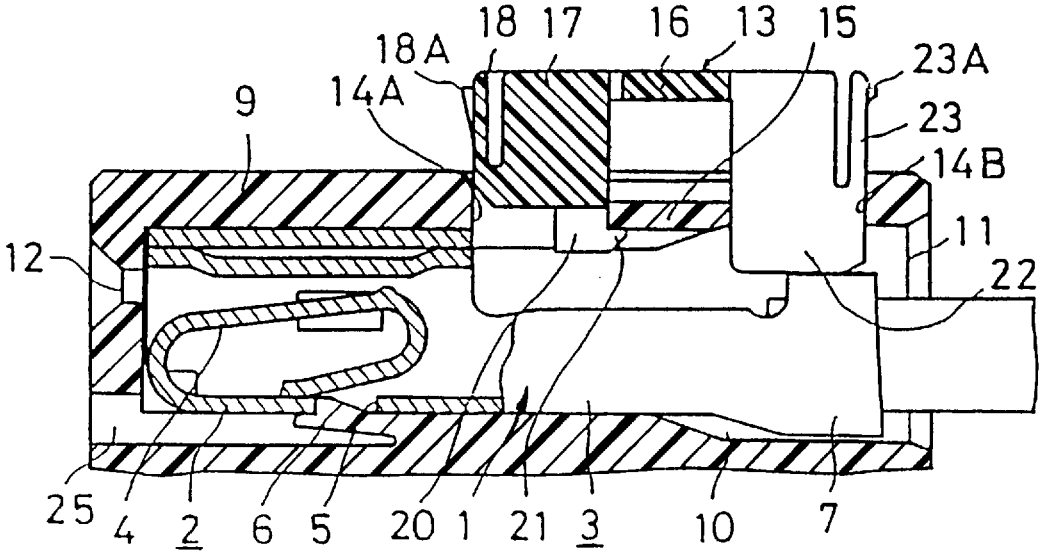
FIG. 2 is a longitudinal cross-sectional view of the first form of connector showing the retainer in an intermediate fitted position.
Figure 8:
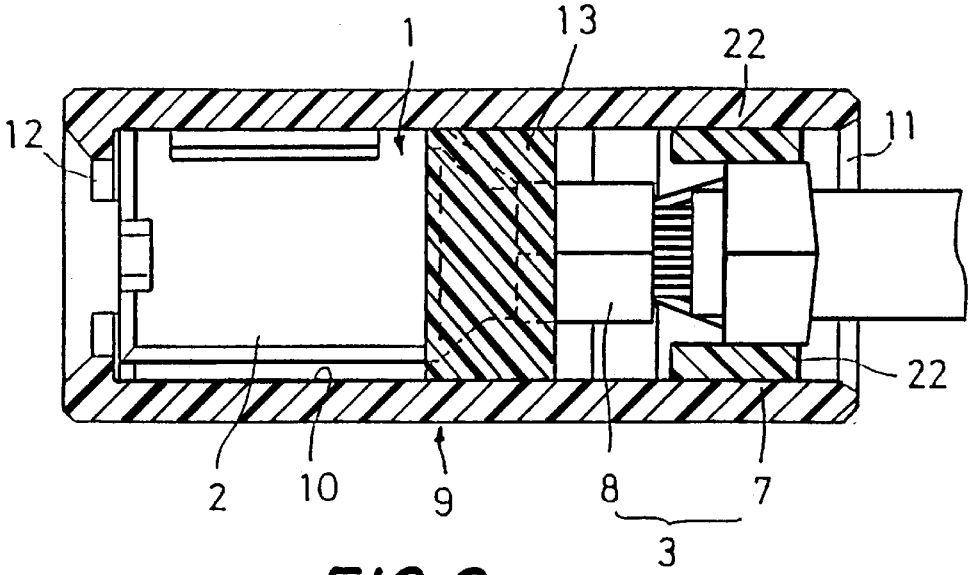
FIG. 8 is a transverse cross-sectional view of the first form of connector showing the retainer in the fully-fitted position.

The crimping member 3 is located at the rear end of the terminal 1, and comprises an insulation barrel 7 for holding that portion of the electric wire which is covered by its insulating sleeve, and a wire barrel 8 for holding the exposed core of the electric wire, this exposed core being located between the insulation barrel and the connector member 2. Moreover, as shown in FIG. 8, the width of the crimping member 3 is less than the width of the connector member 2. When the insulation barrel 7 holds the covered portion of the electric wire, both the external faces thereof bend so as to form substantially vertical faces. When the terminal 1 is inserted into the cavity 10 in the connector housing 9, these vertical faces are arranged to be substantially parallel with respect to the side faces of the cavity. The connector housing 9 is a one-piece member made from synthetic resin material, and is formed internally with the cavity 10. As shown in FIGS. 1 and 2, the cavity 10 is a horizontal cavity. An opening 11 provided at the rear end of the cavity 10 constitutes an insertion opening for inserting the female terminal 1. The front end of the cavity 10 is formed with a front wall that meets the front end of the terminal 1. An insertion hole 12 is formed in this front wall for allowing the insertion of the male terminal.

A lance 6 that can fit with the female terminal 1 is provided on the base of the cavity 10. The lance 6 is formed so as to extend upwardly and forwardly towards the interior of the cavity 10, and is arranged to be bendable in a vertical direction. This flexibility allows the lance 6 to fit resiliently with the aperture 5 of the terminal 1. A space is provided below the lance 6 to allow it to bend; and, towards the front end of the lance, a space 25 is provided that opens towards the front wall. The space 25 serves as an insertion space for a jig (not shown) to engage the lance 6 when the terminal 1 is to be released.

As shown in FIG. 8, the interior of the cavity 10 is formed with very narrow spaces between its side walls and the connector member 2, and with rather wide spaces (of approximately equal width) between its side walls and the sides of both the wire barrel 8 and the insulation barrel 7.

Figure 3:
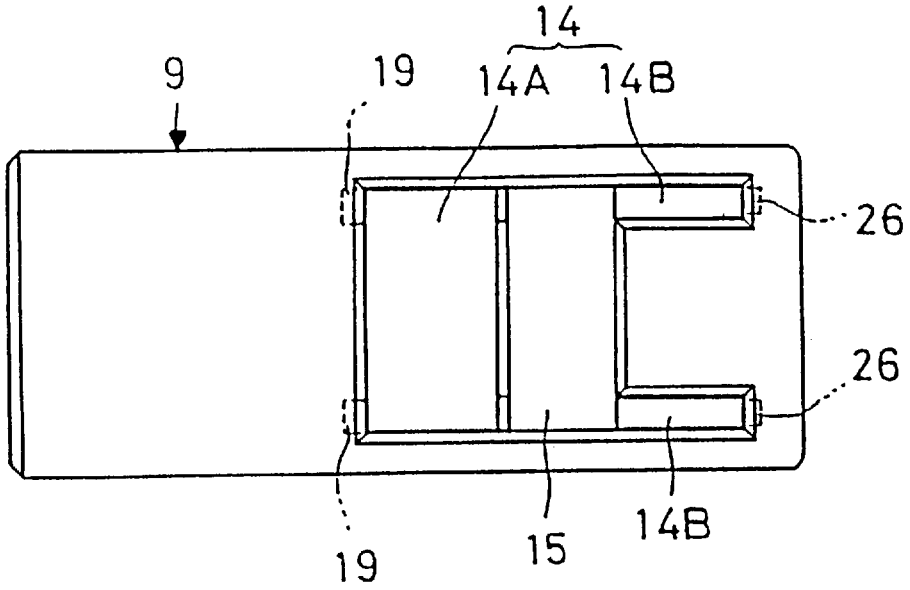
FIG. 3 is a plan view of the housing of the first form of connector.
Figure 4:
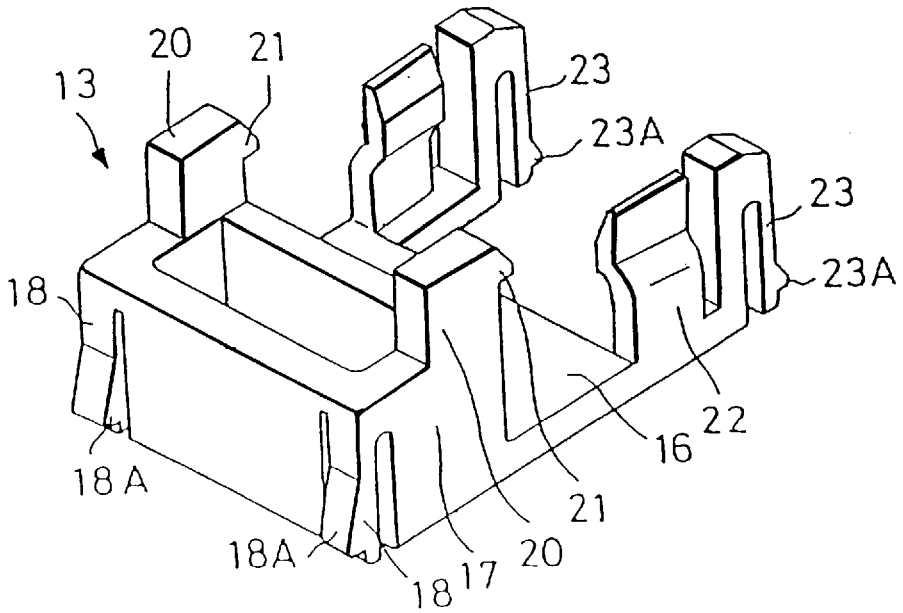
FIG. 4 is a perspective view of the retainer of the first form of connector.
Figure 5:
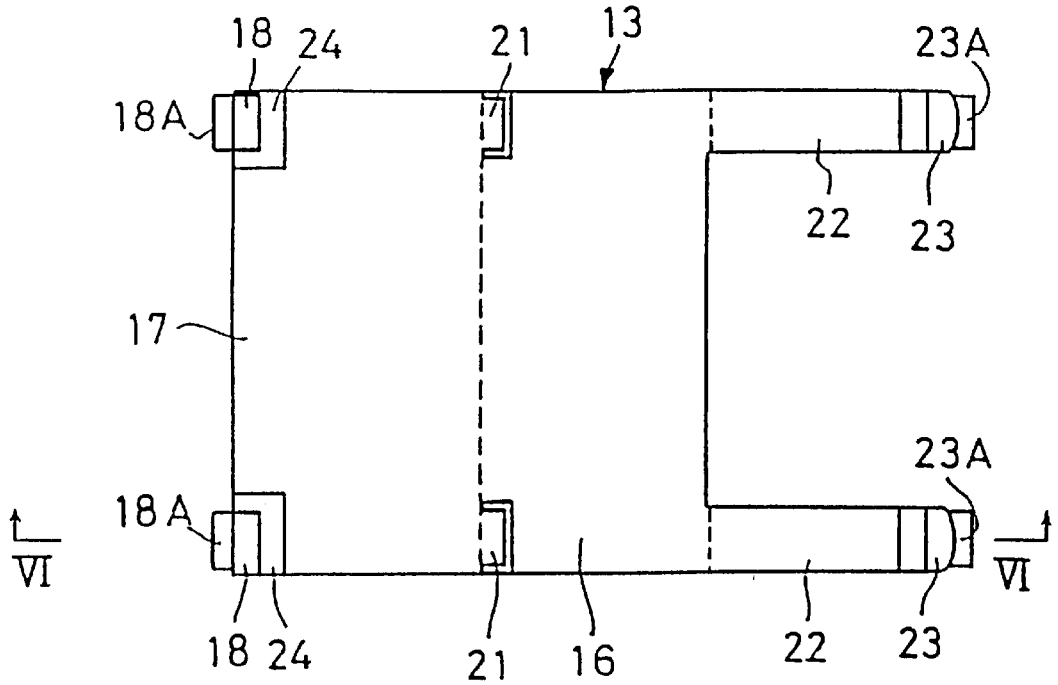
FIG. 5 is a plan view of the retainer of the first form of connector.
Figure 6:
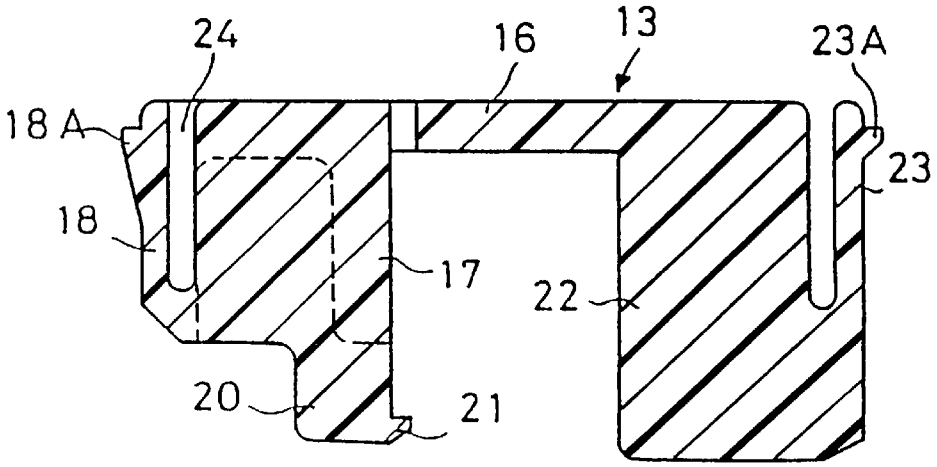
FIG. 6 is a cross-section taken on the lines VI—VI of FIG. 5.
Figure 7:
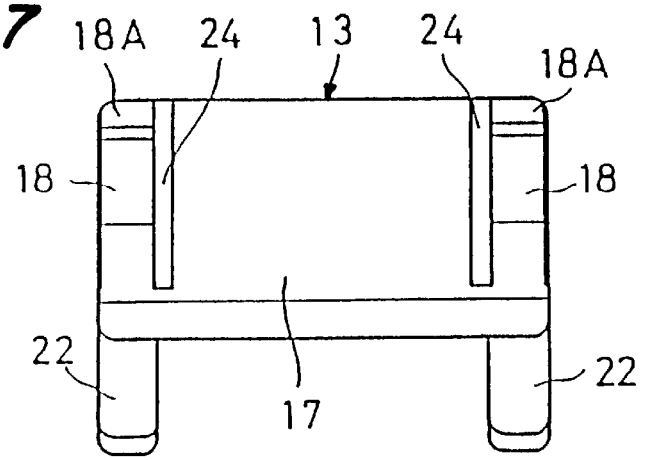
FIG. 7 is front elevation of the retainer of the first form of connector.

As shown in FIG. 3, the upper face of the housing 9 is formed with an attachment aperture 14 for a retainer 13. The retainer 13 is inserted into the attachment aperture 14, and holds the terminal 1 in position in the manner described below.

The attachment aperture 14 is spanned by a bridge member 15 that defines a front aperture 14A and rear apertures 14B, and the attachment aperture passes through to the cavity 10. The bridge member 15 is located at a position lower than the height of the walls surrounding it. The rear apertures 14B extend in the front-rear direction at the left and right sides of the housing 9.

The retainer 13 is a one-piece member made from a synthetic resin material. The retainer 13 has a plate 16 which, in use, rests against the upper face of the bridge member 15. The front lower face of the plate 16 had a downwardly-projecting, rectangular barrel 17 which is open at the bottom. The barrel 17 fits tightly within the front aperture 14A of the housing 9, and its front face is formed with slits 24 on both sides thereof, thereby forming a pair of front stops 18. The front stops 18 are bendable in the front-rear direction, and the front end of each of the stops 18 has a claw 18A projecting therefrom. When the retainer 13 is fully inserted into the aperture 14 (the position shown in FIG. 1), the claws 18A mate with complementary concave members 19 (see FIG. 3) formed at the edges of the front aperture 14A.

The rear corners of the lower face of the barrel 17 are formed with downwardly-extending projections 20. The projections 20 are formed with claws 21 at their ends. When the retainer 13 is in an intermediate fitted position (the position shown in FIG. 2), the claws 21 mate with the front edges of the bridge member 15. Simultaneously, the base portions of both the front stops 18 make contact with the front edge of the front aperture 14A, so that the retainer 13 is supported in the intermediate fitted position. When the retainer 13 is in the fully-fitted position, both the projections 20 are pushed deeply into the cavity 10 and remain in a suspended state between the wire barrel 8 and the side walls of the cavity 10.

The corners at the rear end of the plate 16 are formed with backwardly-extending, play-eliminating members 22. The play-eliminating members 22 are formed so as to enter the interior of the cavity 10 through the rear apertures 14B. Rear stops 23 are formed at the rear of the play-eliminating members 22. These rear stops 23 are formed so as to be bendable in the front-rear direction. Convex members 23A are formed on the rear edges of the rear stops 23. When the retainer 13 is in the fully-fitted position, the convex members 23A mate with complementary concave stops 26 formed adjacent to the rear apertures 14B. The claws 18 and the members 19, and the concave members 23A and the stops 26 thus constitute means for detachably fixing the retainer 13 to the housing.

The play-eliminating members 22 are formed so as to fit tightly in the spaces between the external faces of the insulating barrel 7 and the side face of the cavity 10 (see FIGS. 8 and 9) when the retainer 13 is in the fully-fitted position. Consequently, sideways movement of the terminal 1 can be controlled.

In order to assemble the connector of FIGS. 1 to 9, the retainer 13 is pushed into the aperture 14 until the play-eliminating members 22 mate with the corresponding rear apertures 14B, and the barrel 17 mates with the front aperture 14A. Once the retainer 13 is in this state, it is pushed further in until the bases of the front stops 18 make contact with the front edge of the front aperture 14A, and the claws 21 of the projections 20 mate with the bridge member 15. The retainer 13 is then in the intermediate fitted position, as shown in FIG. 2.

Next, the female terminal 1 is pushed into the cavity 10, through the insertion aperture 11 of the housing 9, until the female terminal strikes the front wall of the cavity. As the female terminal 1 is being pushed in, the lance 6 is pushed down and then reverts to its original position when the female terminal is fully inserted, the lance then mating with the aperture 5. In this way, the terminal 1 is undimensionally stopped in an unremovable position.

Next, the retainer 13 is pushed further in until it reaches the fully-fitted position. When this is done, the plate 16 makes contact with the upper face of the bridge member 15. Simultaneously, the claws 18A of the front stops 18 mate with the corresponding concave members 19, and the convex members 23A of the rear stops 23 mate with the corresponding concave stops 26. As a result, the retainer 13 is held in an unremovable position within the housing 9. When the retainer 13 is in the fully-fitted position, the front face of the barrel of the barrel 17 abuts with the rear face of the connector member 2 of the female terminal 1. As a result, the female terminal 1 is a doubly-stopped position, since it is also held in place by means of the lance 6, and is therefore unremovable.

Figure 9:
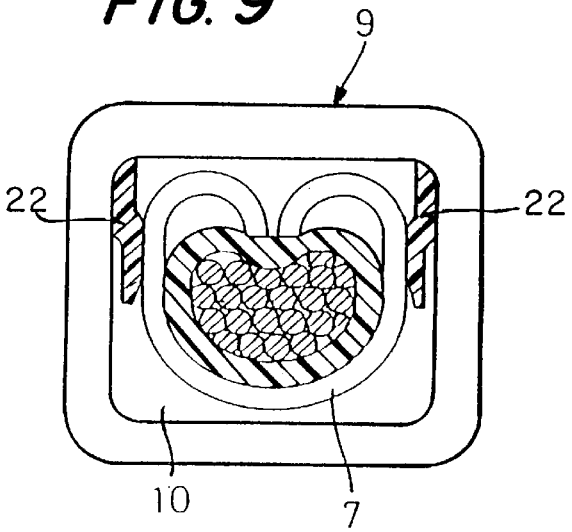
FIG. 9 is a schematic rear elevation showing the terminal of the first form of connector with play eliminated.

Moreover, when the retainer 13 moves to its fully-fitted position, the play-eliminating members 22 fit tightly into the spaces between the insulation barrel 7 and the side walls of the interior of the cavity 10; and, as shown in FIG. 9, clasp and support the female terminal 1 from both sides thereof. As a consequence, sideways movement of the female terminal 1 is prevented, thereby avoiding the production of heat due to the occurrence of friction between the male/female connector pair after these are connected.

Figure 10:
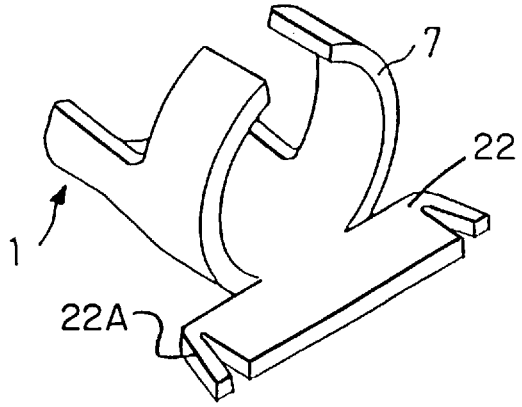
FIG. 10 is an enlarged perspective view of part of the terminal of a second form of electrical connector constructed in accordance with the invention.
Figure 11:
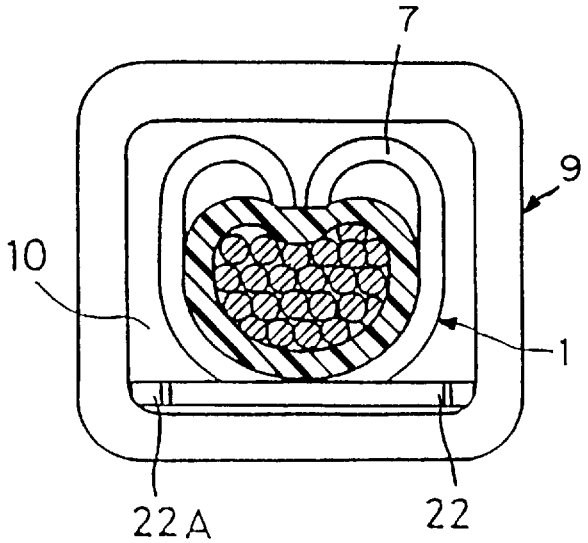
FIG. 11 is a schematic rear elevation showing the terminal of the second form of connector with play eliminated.

FIGS. 10 and 11 show a second embodiment of the present invention. In the second embodiment, play-eliminating members 22 are provided on the terminal 1 itself, the play-eliminating members having the same length and extending laterally, in opposite directions, from the insulation barrel 7 at the rear end of the terminal 1. The ends of the play-eliminating members 22 comprise resilient fingers 22A which contact the side walls of the interior of the cavity 10.

Consequently, once the terminal 1 is inserted into the cavity 10, the side edges of the play-eliminating fingers 22A make contact with the side walls of the interior of the cavity. As a result, sideways movement of the terminal 1 is prevented by means of the play-eliminating fingers 22A. In this way, the connector does not need a retainer 13. Moreover, longitudinal guide grooves (or projecting edges) can be provided within the housing 9 to receive the play-eliminating fingers 22A. If this is done, the play-eliminating fingers 22A can also guide the insertion of the terminal 1.

Figure 12:
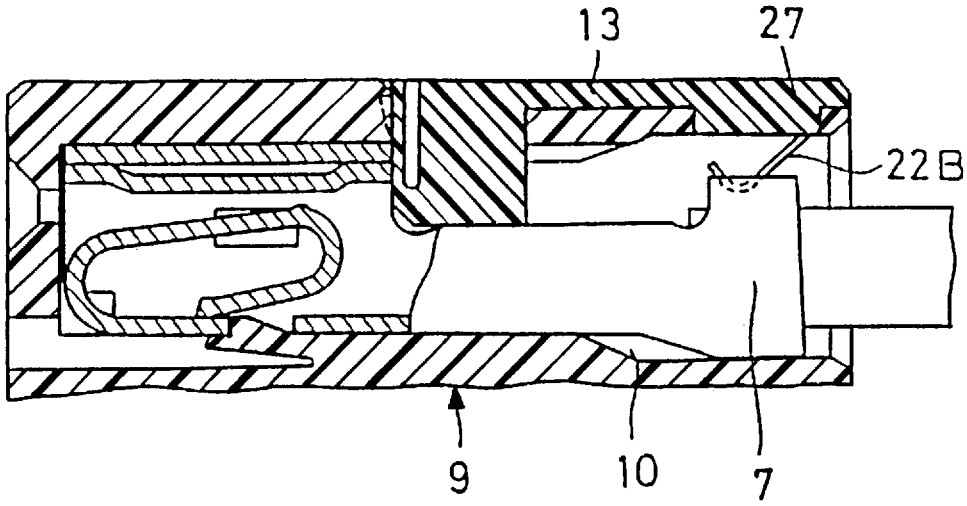
FIG. 12 is a longitudinal cross-sectional view of a third form of electrical connector constructed in accordance with the invention, and showing its retainer in the fully-fitted position.
Figure 13:
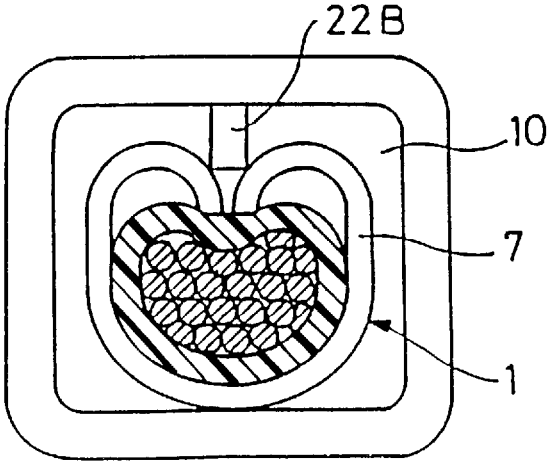
FIG. 13 is a schematic rear elevation showing the terminal of the third form of connector with play eliminated.

FIGS. 12 and 13 show a third embodiment of the present invention. The first and second embodiments described above are configured so as to prevent the terminal 1 moving sideways (horizontally). The third embodiment, however, prevents movement in a vertical direction (and, indirectly, movement in a sideways direction as well). Specifically, a rear central portion of the upper face of the housing 9 has a window member 27 provided thereon, the window member 27 opening into the cavity 10. A play-eliminating member 22B is provided on the retainer 13 so as to project downwards. When the retainer 13 is placed in the fully-fitted position, the play-eliminating member 22B enters the cavity 10 via the window member 27. The front end of the play-eliminating member 22B is formed to curve towards the front in a gently curving J shape, and is formed so as to make resilient contact with the centre of the upper face of the insulation barrel 7 with a predetermined resilient force.

In this case, once the retainer 13 is in the fully-fitted position, the play-eliminating member 22B pushes down the insulation barrel 7 of the terminal 1 with a predetermined resilient force. As a result, even if vibrations are transmitted to the connector, these vibrations are absorbed and the terminal 1 does not have any play in the upwards direction. Consequently, as in the case of both the embodiments described earlier, production of heat within the terminal 1 is prevented. Another advantage of the embodiment of FIGS. 12 and 13 is that any differences in the space between the terminal 1 and the interior walls of the cavity 10 are absorbed due to the springy nature of the play-eliminating member 22B.

It will be apparent that the above invention could be modified in various ways. For example:

(1) Although in the embodiments described, the play-eliminating members 22, 22A and 22B make contact with the terminal 1, this is not essential as long as the position of the terminal is fixed by filling the space between the terminal and the inner walls of the cavity 10.

(2) Although, in the third embodiment, a springy play-eliminating member 22B is arranged to project from the retainer 13, two such members may instead be arranged to project (in appropriate directions) from both the side walls of the cavity 10.

(3) The use of the play-eliminating means is not limited to female terminals; it may equally be used for male terminals.

We claim:

1. An electrical connector comprising a housing having a cavity defined by an interior wall and a transverse opening extending through a sidewall of the housing to communicate with the cavity, a terminal mounted within the cavity, said terminal including a front connector portion for making electrical contact with another connector and a rear wire connection portion having a certain length for connecting to an electrical wire, said connector portion having a width about the same as said cavity and said wire connection portion having a smaller width than the connector portion, and a one-piece retainer received in said transverse opening so as to be at least partially mounted within the cavity following the mounting of said terminal in said cavity, said retainer including at least one lock member for securing the retainer within the housing, opposed support portions defining a width dimension which is about the same as the width of said connector portion, said support portions being flexed during installation in said cavity to firmly press against opposing sides of the rear wire connection portion and the interior wall of the cavity for eliminating play of the terminal in said cavity in a transverse direction, said support portions having engagement faces which engage at least most of the length of the rear wire connection member, and a stop portion to prevent removal of said terminal from said cavity.

2. An electrical connector in accordance with claim 1 wherein the retainer has a U-shaped configuration with a base portion interconnecting the support portions.

3. An electrical connector in accordance with claim 2 wherein the retainer further includes a barrel portion projecting from said base forward of said support portions.

4. An electrical connector in accordance with claim 1 wherein the retainer includes a pair of projections with securing elements for supporting the retainer in an intermediate position.

* * * * *